United States Patent [19]

Austin et al.

[11] 4,114,812

[45] Sep. 19, 1978

[54] SPRAY NOZZLE

[75] Inventors: Forrest L. Austin, Brooklyn Center; Richard T. Cornelius, Minnetonka, Minn.

[73] Assignee: The Black and Decker Manufacturing Company, Towson, Md.

[21] Appl. No.: 751,207

[22] Filed: Dec. 16, 1976

Related U.S. Application Data

[62] Division of Ser. No. 629,757, Nov. 11, 1975, Pat. No. 4,070,725.

[51] Int. Cl.[2] ..... B05B 11/00

[52] U.S. Cl. ..... 239/492; 239/532; 285/320

[58] Field of Search ..... 239/491, 493, 600, 532, 239/492; 285/319, 320, 309, 310, 176, DIG. 22

[56] References Cited

U.S. PATENT DOCUMENTS

| | | | |
|---|---|---|---|
| 1,007,795 | 11/1911 | Peabody | 239/493 |
| 2,080,264 | 5/1937 | Gray | 239/492 X |
| 2,520,215 | 8/1950 | Kerr | 285/320 X |
| 2,535,166 | 12/1950 | Smith | 239/491 |
| 3,482,784 | 12/1969 | Webster | 239/493 |
| 3,540,658 | 11/1970 | Simmons | 239/492 X |
| 3,700,174 | 10/1972 | Beck | 239/526 |
| 3,961,756 | 6/1976 | Martini | 239/493 |

*Primary Examiner*—Joseph F. Peters, Jr.
*Assistant Examiner*—Michael Mar
*Attorney, Agent, or Firm*—Hill, Gross, Simpson, Van Santen, Steadman, Chiara & Simpson

[57] ABSTRACT

A nozzle assembly has a body with an axially closed end, and a radially apertured cup-like discharge chamber on the outside of the closed end, and a nozzle cap carried on the outside of the body, and having an annular seat surrounding its discharge opening, the seat being engageable with the body around the discharge chamber. The assembly is adapted to be non-threadedly secured to a source of liquid pressure, there being an extension which can be disposed between such source of liquid pressure and the body. The spray nozzle and spray nozzle extension are adapted to be connected to the discharge of a pump by which the pump is converted into a sprayer.

3 Claims, 4 Drawing Figures

Fig. 1
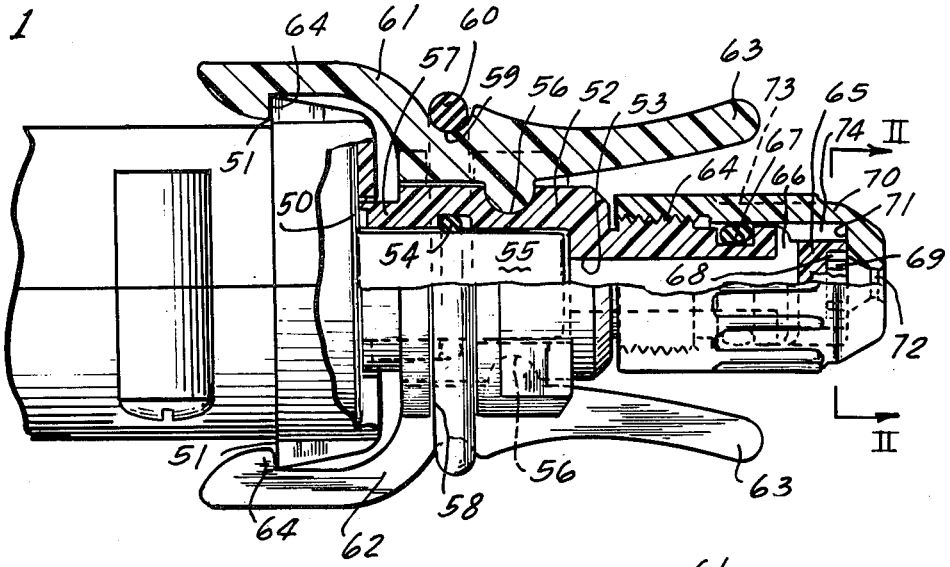
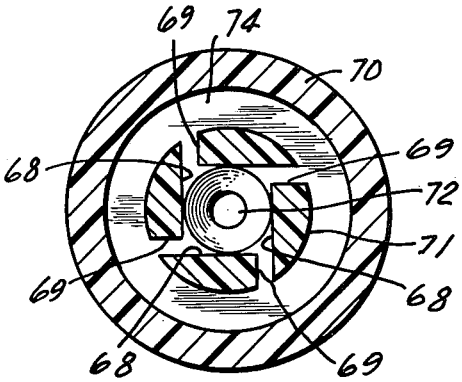
Fig. 2
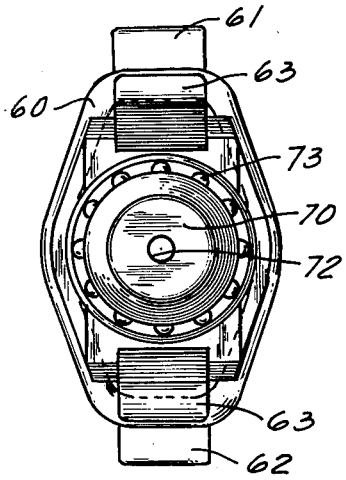
Fig. 3
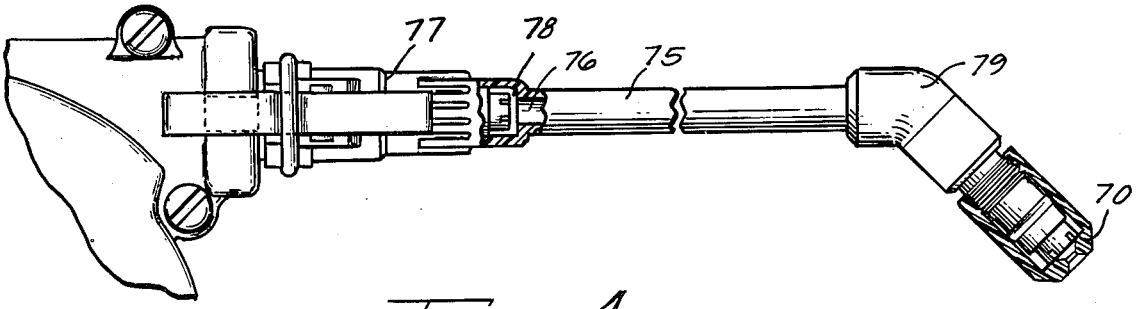
Fig. 4

SPRAY NOZZLE

RELATED APPLICATION

This application is a division of our copending application Ser. No. 629,757, filed Nov. 11, 1975, now U.S. Pat. No. 4,070,725.

BACKGROUND OF THE INVENTION

Field of the Invention

This invention pertains to a spray nozzle, and more specifically to means by which a pump can be converted into a pump-sprayer.

SUMMARY OF THE INVENTION

The present invention is directed to a nozzle assembly which includes a body having a bore leading to a closed end which has radial apertures, the body having a cup-like discharge chamber on the outside of the closed end, which chamber is also radially apertured, and a nozzle cap carried on the outside of the body, and having an annular seat surrounding a discharge opening, the seat being selectably engageable with the body around the discharge chamber. Accordingly, it is an object of the present invention to provide a particularly effective adjustable spray nozzle.

A further object of the present invention is to provide a nozzle assembly by which a pump may be readily converted into a sprayer.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWINGS

FIG. 1 is an enlarged cross-sectional view of a spray nozzle assembly secured to the discharge end of a pump;

FIG. 2 is an enlarged cross-sectional view taken along line II—II of FIG. 1;

FIG. 3 is a front elevational view of the structure of FIG. 1; and

FIG. 4 is a side elevational view of the structure of FIG. 1, partly in cross-section, and fitted with an extension tube.

AS SHOWN ON THE DRAWINGS

The principles of the present invention are particularly useful when embodied in a nozzle assembly as shown in FIG. 1. The nozzle assembly is illustrated as being mounted on the discharge portion of a housing 12 of a pump, there being an opening 50 in the housing 12 which is non-circular, and adjacent thereto, there are a pair of rearwardly facing shoulders 51,51. For further details of the pump, reference is made to our U.S. patent identified in the heading.

A nozzle body 52 has a stepped bore 53 therein which, at its larger diameter is internally grooved to receive a sealing ring 54 for engaging a projecting portion 55 of the outlet fitting 27. The body 52 has a pair of oppositely facing pivot seats 56,56 a nose portion 57 of non-circular external configuration receivable in the opening 50, and a pair of laterally opening slots 58 which lead to corresponding notches 59 which slots and notches receive an O-ring 60 tensionably carried thereon as a resilient spring. The notches 59 form part of a pair of pivoted clamping levers 61,62 that can be manually brought together at one end 63 to disengage a hook 64 from the shoulder 51. The distal end of each of the hooks 64 is tapered, as is the adjacent forward surface of the housing 12, to enable the body 52 with the clamping means thereon to be snapped onto the pump. The body 52 with the clamping means carried thereon forms a separable portion of the nozzle assembly, such portion being adapted to be used as a part of various components to be secured to the pump housing 12, such as an extension described below. To that end, the body 52 is provided with a set of external threads 64 for being associated with structure next to be described, or for being associated with structure shown in FIG. 4. In FIG. 1, the body 52 is part of the nozzle assembly wherein the bore 53 is open at one end to communicate with the outlet of the pump housing 12, and is closed at its other end 65. The body 52 has a number of radial apertures 66 adjacent to the closed end 65 which communicate with the bore 53. Between the radial apertures 66 and the threads 34, the body 52 has sealing means 67 which prevent leakage past the threads 64. The body 52 has a cup-like discharge chamber 68 outside of the closed end 65, the chamber being forwardly open and of square configuration thus leaving an annular forwardly facing flange on the body, the same being radially apertured in a direction which is more specifically substantially parallel to the walls of the square discharge chamber 68, the apertures being shown at 69. The nozzle assembly further includes a nozzle cap 70 disposed between the clamping levers 61,62 and threaded onto the body threads 64 and engaging the seal 67, and having an annular seat 71 surrounding an opening 72, the annular seat 71 being engagable with the distal end of the body 52 at the apertured annular portion which encircles and defines the cuplike discharge chamber 68. The nozzle cap 70 limits travel of the gripping ends 63 of the clamping levers 61,62. As best seen in FIG. 3, the nozzle cap 70 is provided with gripping means 73 to facilitate adjustment thereof. The adjustment is maintained by full tightening of the nozzle cap 70 to get maximum spraying and maximum dispersion, and the adjustment in non-fully tightened positions is maintained by the compression seal 67. Liquid typically containing desirable chemicals for vegetation enters the bore 53 and passes through the radial apertures 66 and then flows to an annular chamber 74 which communicates with the discharge opening 72 directly when the annular seat 71 is disengaged. This provides as sharply a focused stream as is possible to direct the liquid a maximum distance. As the annular seat 71 is brought toward the radially apertured discharge chamber 68, progressively less water can pass across the annular seat 71 and more passes into the openings 69, the liquid being caused to swirl within the discharge chamber 68 before it passes through the discharge opening 72. As the liquid emerges from the discharge opening 72, it is in the form of a fine spray.

It is not always convenient to have a nozzle assembly discharge within an inch or so of the device to which it is attached. To overcome this problem, there is provided an extension tube 75 of a desired length to enable the user to discharge spray near the ground, to discharge spray on surfaces located beyond the upward reach of the user, and the like. The extension tube 75 is inserted on the structure of FIG. 1 between the body 52 and the nozzle cap 70. To that end, the left end in FIG. 4 of the extension tube 75 has a construction which is internally identical to the nozzle cap 70 except that a discharge opening 76, corresponding to the discharge opening 72 is made larger, and the step in the bore is made deeper so that even if the fitting is turned on the threads 64 to produce engagement as at 77, there will still be a substantial clearance at the space 78 so that there can be no seating as is done by the annular seat 71. The other end of the extension tube 75 is provided with an angle fitting 79 or body constructed downstream of such bend identically to the corresponding portion of the body 52 and receives the nozzle cap 70. The O-ring 67 acts on the left end of the extension tube 75 to provide both a seal and to hold the extension tube 75 against rotation when it is rotated to a position that would direct the nozzle cap 70 in a direction other than that shown, about the longitudinal axis of the extension tube 75.

Although various minor modifications might be suggested by those versed in the art, it should be understood that we wish to embody within the scope of the patent warranted hereon, all such embodiments as reasonably and properly come within the scope of our contribution to the art.

What we claim as our invention is:

1. A nozzle assembly, comprising:

(a) a nozzle body with a bore therein, open at one end to be coupled to a source of pressurized liquid, and closed at the other end, said nozzle body having external threads, having a diametral aperture near said closed end intersecting said bore, and having peripheral sealing means at said threads, said nozzle body having a cup-like discharge chamber on the outside of said other end which is radially apertured;

(b) a nozzle cap threaded onto said nozzle body and coacting with said seal, and having an opening, and an annular seat surrounding said opening and selectably engaging said other end of said nozzle body around said discharge chamber; and (c) a one-piece extension tube selectably disposed directly between said nozzle body and said nozzle cap, one end of said extension tube being internally threaded to be interchangeable with said nozzle cap, there being an internal clearance for preventing engagement with said other end of said nozzle body, the other end of said extension tube being a further body portion corresponding in structure to that of said nozzle body for carrying said nozzle cap.

2. A nozzle assembly according to claim 1, in which said nozzle body has a non-circular formation at said one end for nesting with non-circular structure on the source of pressurized liquid, whereby relative rotation is precluded.

3. A nozzle assembly according to claim 1, including resiliently biased clamping levers on said body, for each having at one end releasable locking engagement with the source or pressurized liquid, and the other end being engageable with said nozzle cap to limit unclamping movement.

* * * * *